US012421633B2

(12) United States Patent
Küttel et al.

(10) Patent No.: US 12,421,633 B2
(45) Date of Patent: Sep. 23, 2025

(54) DEVICE FOR OILING A MOVING YARN

(71) Applicant: SSM Schärer Schweiter Mettler AG, Wädenswil (CH)

(72) Inventors: Martin Küttel, Gattikon (CH); Franz Böni, Leissigen (CH)

(73) Assignee: SSM Schärer Schweiter Mettler AG, Wädenswil (CH)

( * ) Notice: Subject to any disclaimer, the term of this patent is extended or adjusted under 35 U.S.C. 154(b) by 24 days.

(21) Appl. No.: 18/174,107

(22) Filed: Feb. 24, 2023

(65) Prior Publication Data

US 2023/0272560 A1 Aug. 31, 2023

(51) Int. Cl.
*D02J 3/18* (2006.01)
*B65H 71/00* (2006.01)

(52) U.S. Cl.
CPC ..... *D02J 3/18* (2013.01); *B65H 71/007* (2013.01)

(58) Field of Classification Search
CPC ... B01H 13/306; B65H 71/007; D01H 13/306
See application file for complete search history.

(56) References Cited

U.S. PATENT DOCUMENTS 2,526,848 A * 10/1950 Campbell ..... B65H 71/007 118/244
3,222,857 A * 12/1965 Johann ..... D01H 13/306 57/58.49
4,040,241 A * 8/1977 Speranzin ..... D01H 13/306 57/296

FOREIGN PATENT DOCUMENTS

| | | | | |
|---|---|---|---|---|
| CN | 106698078 A | * | 5/2017 | |
| CN | 207 452 340 U | | 6/2018 | |
| CN | 208545538 U | | 2/2019 | |
| CN | 209 636 478 U | | 11/2019 | |
| CN | 209636499 U | | 11/2019 | |
| CN | 213086176 U | | 4/2021 | |
| DE | 60035620 T2 | | 5/2008 | |
| EP | 1405938 A1 | | 4/2004 | |
| EP | 3575458 A1 | * | 12/2019 | ..... D01H 1/115 |
| WO | WO2009036773 A1 | | 3/2009 | |

OTHER PUBLICATIONS

CN213086176U Machine Translation (Year: 2021).*
CN209636499U Machine Translation (Year: 2019).*
Swiss Patent Office Search Report, Jul. 25, 2022.

* cited by examiner

*Primary Examiner* — Spencer E. Bell
(74) *Attorney, Agent, or Firm* — Dority & Manning, P.A.

(57) ABSTRACT

A device for oiling a moving yarn includes a controller, a housing, an oil port provided in the housing, and a dosing pump arranged in the housing. A yarn guiding device with an oil transfer element is mounted in the housing. The oil transfer element is connected to the oil port by an oil feed channel via the dosing pump. A closure element and a flow sensor are provided in the oil feed channel. The oil feed channel has a first portion from the oil port to the dosing pump, a second portion from the dosing pump to the closure element, and a third portion from the closure element to the oil transfer element. The flow sensor is provided in the second portion of the oil feed channel.

15 Claims, 2 Drawing Sheets

DEVICE FOR OILING A MOVING YARN

FIELD OF THE INVENTION

The present invention relates to a device for oiling a moving yarn having a housing, having a dosing pump arranged in the housing and having a yarn guiding device with an oil transfer element mounted in the yarn guiding device, wherein the oil transfer element is connected to the oil port through an oil feed channel via the dosing pump.

BACKGROUND

Generic devices are known from the prior art, for example CN 208 545 538 U discloses a device for oiling a moving yarn with a dosing pump which is designed as a gear pump and is driven by an electric motor. The oil is supplied via a supply line from the dosing pump to a sponge inserted in a yarn guide groove, via which the oil is applied to the yarn. In addition, a heater is provided for heating the oil. Furthermore, the use of a heating plate for heating the oil is known from CN 209 636 478 U. A disadvantage of the known embodiments is that, due to the pressure conditions in the oil distribution, there is an overrun of oil from the dosing pump to the yarn guiding device when the device is at a standstill. This leads to contamination of the device and must always be removed before a restart to avoid contamination of the yarn. CN 207 452 340 U attempted to overcome this disadvantage by providing a device for oiling a moving yarn with an inserted yarn guiding device which has a protective cover. Although this prevents oil from leaking out of the device, it does not prevent oil from running into the yarn guiding device. A further disadvantage is that the amount of oil absorbed by the yarn is determined by empirical settings of the oil pump and cannot be adapted to conditions such as a slowed yarn run.

SUMMARY OF THE INVENTION

Thus, it is an object of the present invention to propose a device for oiling a moving yarn or thread which prevents unintentional oil leakage and permits precise dosing of the amount of oil. Additional objects and advantages of the invention will be set forth in part in the following description, or may be obvious from the description, or may be learned through practice of the invention.

The objects are solved by a device and a method having the features of described and claimed herein.

A device for oiling a moving yarn is proposed, having a controller and a housing. An oil port is provided in the housing and a dosing pump is arranged in the housing. A yarn guiding device has an oil transfer element mounted therein, wherein the oil transfer element is connected to the oil port through an oil feed channel via the dosing pump. A closure element and a flow sensor are provided in the oil feed channel. The oil feed channel has a first portion from the oil port to the dosing pump, a second portion from the dosing pump to the closure element, and a third portion from the closure element to the oil transfer element, wherein the flow sensor is provided in the second portion. The device is supplied with oil from a reservoir, which is connected to the oil port via a conduit. A hose connection has proven to be useful, which makes it easy to change the type of oil. The oil port can also be used to introduce a cleaning agent for maintenance and cleaning of the device.

The yarn is usually wetted with an oil quantity of 0.4 ml/(running kilometer) to 10 ml/(running kilometer). The amount of oil to be used depends on the type of yarn and the subsequent use of the yarn. For the use of the device in common winding machines or spinning systems, a dosing pump capacity of 0.1 ml/min to 30 ml/min results, taking into account the yarn speeds, can be used. The dosing pump delivers the oil in the required quantity to the oil transfer element which is embedded in the yarn guiding device. The moving yarn in the yarn guiding device comes into contact with the oil transfer element, resulting in a transfer of oil to the yarn. The oil feed channel incorporated in the housing from the oil port to the yarn transfer element is designed in three portions. The individual portions can be designed as bores or channels in the housing or as pipelines. Bores and channels which are completely surrounded by the housing are preferable to screwed or otherwise connected pipelines, since there is no possibility of leakage.

The first portion of the oil feed channel leads from the oil port to the dosing pump. The oil port is advantageously designed as an internal thread or a commercially available coupling for hose lines. The dosing pump may be integrated into the housing of the device, in such a manner that a housing of the dosing pump is an integral part of the housing of the device. The second portion of the oil feed channel leads from the dosing pump to the closure element. The flow sensor is installed in this portion. The flow sensor detects the amount of oil delivered from the dosing pump to the oil transfer element. The flow sensor is designed as an ultrasonic or Coriolis mass flow meter, for example. A calorimetric flow meter has proven to be the preferred design, since it can measure even the smallest quantities of oil pumped. With the aid of the flow sensor, uniform wetting of the yarn with oil is possible, and the controller can also react to a change in a yarn speed with a corresponding reduction in the oil supply. The closure element following the second portion has the advantage that no oil can reach the oil transfer element if, for example, no yarn is fed through the yarn guiding device or no oiling of the yarn is necessary. The closure element prevents oil from dripping through the oil transfer element during standstill and contaminating the yarn guiding device or the surroundings thereof. In addition, cleaning of the yarn guiding device or the oil transfer element before restarting the device can be avoided.

The third portion of the oil feed channel leads from the closure element to the oil transfer element. The oil transfer element is embedded in the yarn guiding device and is designed, for example, as a sponge or other type of porous element. The oil brought to the oil transfer element through the third portion of the oil feed channel penetrates the oil transfer element and is transferred to the yarn by contact between the oil transfer element and the yarn passing by it.

Preferably, the dosing pump is designed as a gear pump with a controlled electric motor. Gear pumps are known from the prior art and have proven themselves for pumping very small quantities under low pressure. Via the controlled electric motor, easy access of the controller to a dosing of a feed quantity is possible. In the embodiment, the controlled electric motor may be, for example, a servo motor or a motor with a frequency control.

Preferably, the closure element is a shut-off valve with an electromagnetic drive. Shut-off valves have the advantage that they are of simple design and can be installed in the housing of the device to completely close the oil feed channel accordingly. The electromagnetic drive allows the shut-off valve to be switched in such a manner that it is closed in the currentless state. Thus, in the event of a plant shutdown, no energy is required to keep the shut-off valve closed and even in the event of a power failure, the shut-off valve closes automatically.

It is advantageous if the third portion of the oil feed channel is at least partially designed as a heating coil. In the third portion, the oil is fed through a heating coil, which can be formed as a single winding or as a multiple winding in the form of a spiral. In the heating coil, the oil is heated to a higher temperature than in the storage condition. Here, a certain amount of heating energy is introduced into the heating coil. The amount of energy is kept constant by the controller according to the type of oil used and the yarn to be oiled. Preferably, the heating coil is provided with a temperature difference measurement. In this case, an input temperature measurement is provided at the input of the heating coil and an output temperature measurement is provided at the output of the heating coil. The measured temperatures are used to control the supply of heating energy to the heating coil. This has the advantage that an ideal viscosity of the oil can always be set, regardless of the operating load of the device. This results in a uniform wetting of the yarn that is consistent over the entire length of the yarn.

Preferably, the yarn guiding device is mounted on an outside of the housing and open to surroundings of the device. Attaching the yarn guiding device to an outside of the housing results in easy access and thus easy threading of the yarn into the yarn guiding device. The yarn guiding device can consist of a plurality of components, for example, separate guide plates can be used to guide the yarn at the upper and lower ends of the housing. Such guide plates are characterized by a guide slot, which has a lateral opening, whereby the yarn, once threaded, cannot jump out of the guide by itself. The two guide plates can be connected to a central part of the yarn guiding device, which is arranged between them and contains a guide groove.

For easy replacement for maintenance and repair purposes, it is advantageous if the yarn guiding device is held in the housing in such a manner that it can be moved linearly. This means that the yarn guiding device can be easily dismantled even if it has to be replaced, for example due to a change in the material of the yarn. In this case, a longitudinal groove corresponding to the yarn guiding device is provided for holding the yarn guiding device in the housing. Within this longitudinal groove, the yarn guiding device can be inserted and held in place by pins, screws or clips. To ensure precise guidance of the yarn, the yarn guiding device is preferably connected to the housing via a dovetail guide. This makes it possible to achieve precise alignment of the yarn guide with an outlet of the oil from the third portion of the oil feed channel. Alternatively, a clamping guide is also conceivable, in which the yarn guiding device is held in a defined position in the housing by elastic plastic elements, for example. Embedded in the yarn guiding device is an oil transfer element which is usually a sponge or made of a porous material in such a manner that the oil can pass through the oil transfer element onto the yarn. Advantageously, the oil transfer element is detachably connected to the yarn guiding device. The oil transfer element is a consumable part and must therefore be replaced at specified intervals. Due to the detachable connection between the oil transfer element and the yarn guiding device, only the oil transfer element can be replaced at a given time and the yarn guiding device remains unaffected.

Advantageously, the controller is attached to or integrated into the housing. The controller or rather the housing is preferably provided with a visualization for displaying operating states, measured values such as temperature, flow rate, consumption, etc. and a keypad for operating the device and entering control parameters. The visualization can be realized with a touch screen, wherein the keypad can be integrated into this touch screen and does not have to be present separately. However, simple visualization by means of simple colored luminous displays and a separate keypad can also be provided. This type of controller design makes it possible to operate the device for oiling a moving yarn as an autonomous element that is independent of a superordinate controller.

Likewise, the data of the measurements and operating states of the device can be transmitted to a superordinate controller by a wired or a wireless communication. A corresponding interface between the controller of the device and a superordinate controller enables remote control of the device for oiling a moving yarn.

Preferably, the visualization provides a display of at least one of the following: an oil quantity; an oil temperature; an oil consumption; an operating state; an operating mode; an operating time; an operating instruction. For example, an operating instruction may include a note on necessary maintenance or replacement of consumable parts. Furthermore, static values can also be output via the visualization.

Furthermore, a method for oiling a moving yarn is proposed with a device according to the preceding description. The device has a controller, a housing, an oil port provided in the housing, a dosing pump with a drive motor arranged in the housing, and a yarn guiding device with an oil transfer element mounted in the yarn guiding device, wherein the oil transfer element is connected to the oil port through an oil feed channel via the dosing pump. Oil is fed from an oil port to the dosing pump via a first portion of the oil feed channel. Subsequently, the oil is pumped via a second portion of the oil feed channel through a flow sensor to a closure element and via a third portion of the oil feed channel to the yarn guiding device, wherein the controller closes the oil feed channel by actuating the closure element when the dosing pump is at a standstill. Closing the oil feed channel prevents oil from dripping out of the oil transfer element and contaminating the yarn guiding device when the machine is at a standstill or the device is not being used for oiling a moving yarn. Depending on the viscosity of the oil used, a larger quantity of oil can flow out of the oil transfer element even after the dosing pump has been switched off and contaminate machine elements or yarn bodies arranged below the device.

Preferably, the controller regulates an oil quantity reaching the yarn guiding device via the drive motor of the dosing pump. Due to the built-in flow sensor, the controller can perform a target/actual comparison of the oil quantity and regulate the feed quantity of the dosing pump accordingly. The target values for the control can be entered on the controller via the keypad or are stored, for example, in a database in the controller itself, in such a manner that when the yarn to be processed is entered, the controller automatically sets the necessary oil feed quantity.

Preferably, a heating coil having an input temperature measurement and an output temperature measurement is provided and a temperature of the oil at an output of the heating coil is controlled by the controller. The temperature to be controlled must be determined as a function of the oil used and specified to the controller.

Preferably, the controller is designed in such a manner that the device is operated autonomously, wherein communication is conducted via the visualization and the keypad. As a result, the device can be used for oiling a moving yarn in a stand-alone operation and is versatile for use in different locations, since there is no dependence on a superordinate controller.

Preferably, the controller is connected to a superordinate machine controller and a control of an oil dosing quantity and/or an oil temperature is determined by the superordinate machine controller. Two-way communication of the device's controller with a superordinate controller allows the wetting of the moving yarn to be matched to the operation of the machine. This has the advantage, for example, that when the winding machine in which the device is used stops, an amount of oil can be lowered correspondingly in synchronism with a slowing of a yarn speed, thereby preventing an application of excess oil to the moving yarn.

BRIEF DESCRIPTION OF THE DRAWINGS

Further advantages of the invention are described in subsequent exemplary embodiments. In the figures.

DETAILED DESCRIPTION

Figure 1:
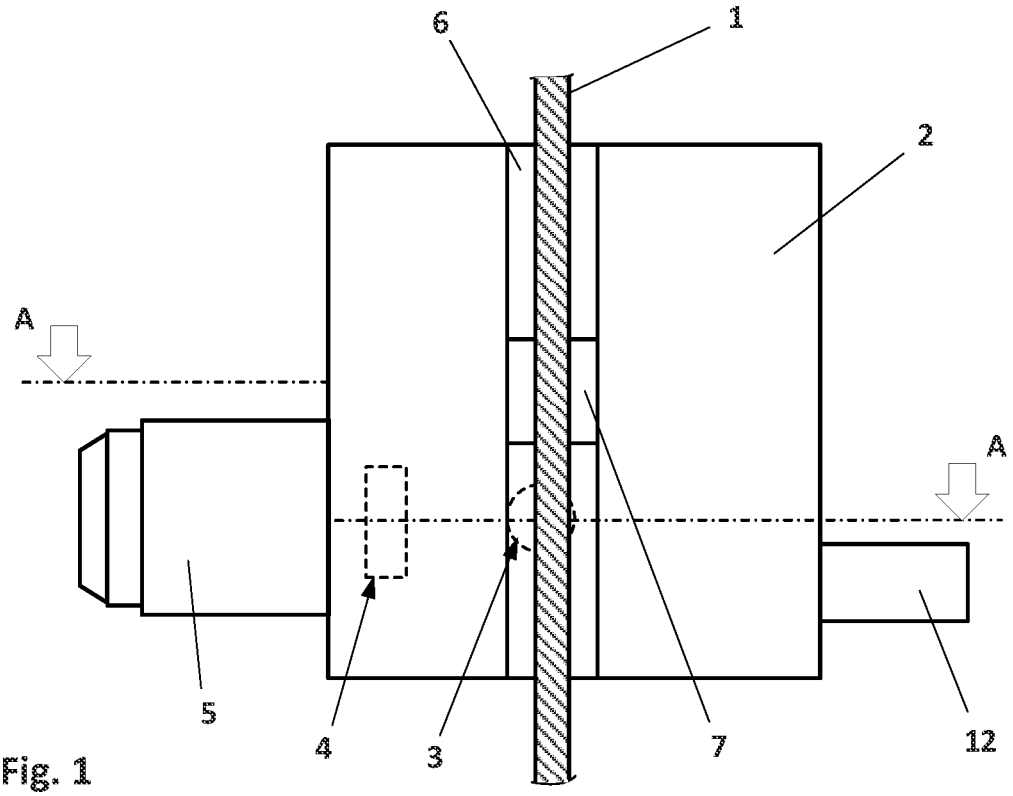
FIG. 1 shows a schematic view of a first embodiment of a device according to the invention.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

Figure 2:
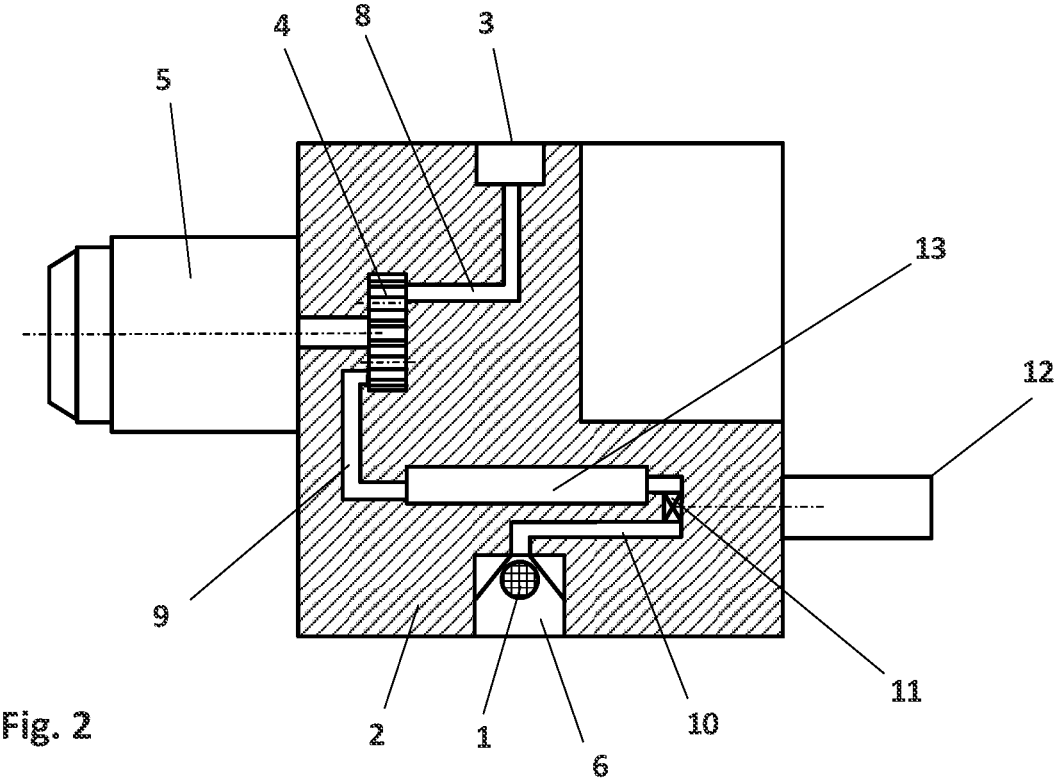
FIG. 2 shows a schematic sectional view at the location A-A according to FIG. 1.

FIG. 1 shows a schematic view of a first embodiment of a device according to the invention and FIG. 2 shows a schematic sectional view at the location A-A according to FIG. 1. A housing 2 has a yarn guiding device 6 along which a yarn 1 is guided along the housing 2. In this case, the yarn guiding device 6 is open to the surrounding, in such a manner that it is easy to insert the yarn 1 into the yarn guiding device 6. Likewise, the entire extension of the yarn 1 in the yarn guiding device 6 can be seen from the outside. An oil transfer element 7 is embedded in the yarn guiding device 6. As the yarn 1 slides past the oil transfer element 7, oil is mechanically transferred to the yarn 1. The oil is brought to the device from a reservoir (not shown) and introduced into the housing 2 via an oil port 3. From the oil port 3, the oil passes through an oil feed channel to the oil transfer element 7. In the embodiment shown, the oil feed channel is fully integrated in the housing 2. A first portion 8 of the oil feed channel connects the oil port 3 to a dosing pump 4. The dosing pump 4 is designed as a gear pump and is driven by a drive motor 5. The drive motor 4 is attached to the housing 2. In a second portion 9 of the oil feed channel, the oil is led from the dosing pump 4 to a closure element 11. The closure element 11 has an electromagnetic drive 12, in which case the closure element 11 is built into the housing 2 and the electromagnetic drive 12 is attached to the housing 2. The closure element 11 can be used to close the oil feed channel between the second portion 9 and a third portion 10 in such a manner that no oil can reach the oil transfer element 7 when the device is at a standstill. In this second portion 9, a flow sensor 13 is also provided, this serves to measure a quantity of oil flowing through the second portion 9. The third portion 10 connects the closure element 11 to the oil transfer element 7.

Figure 3:
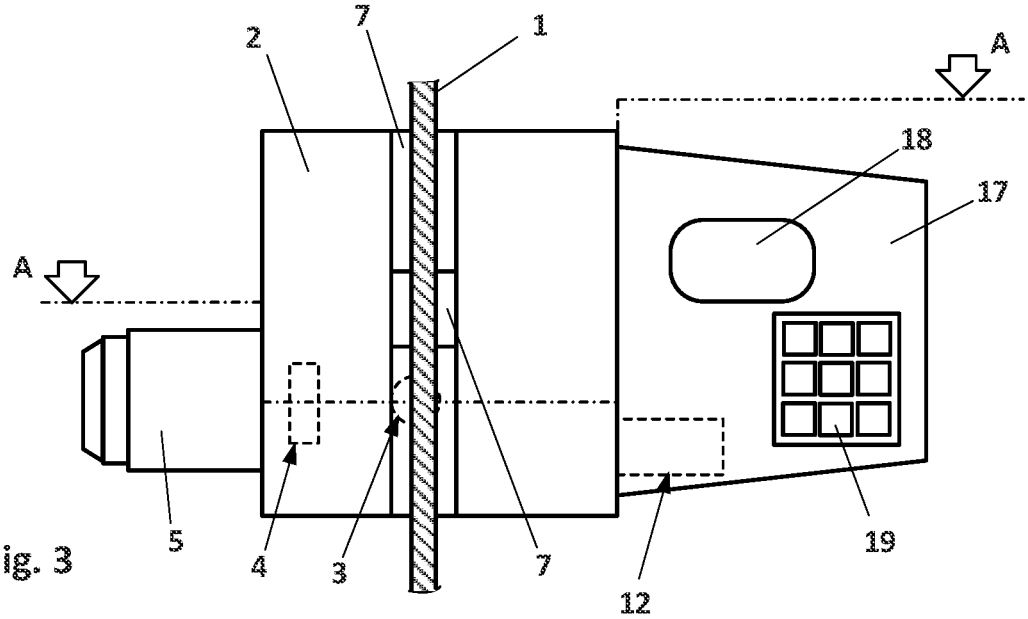
FIG. 3 shows a schematic view of a second embodiment of a device according to the invention.
Figure 4:
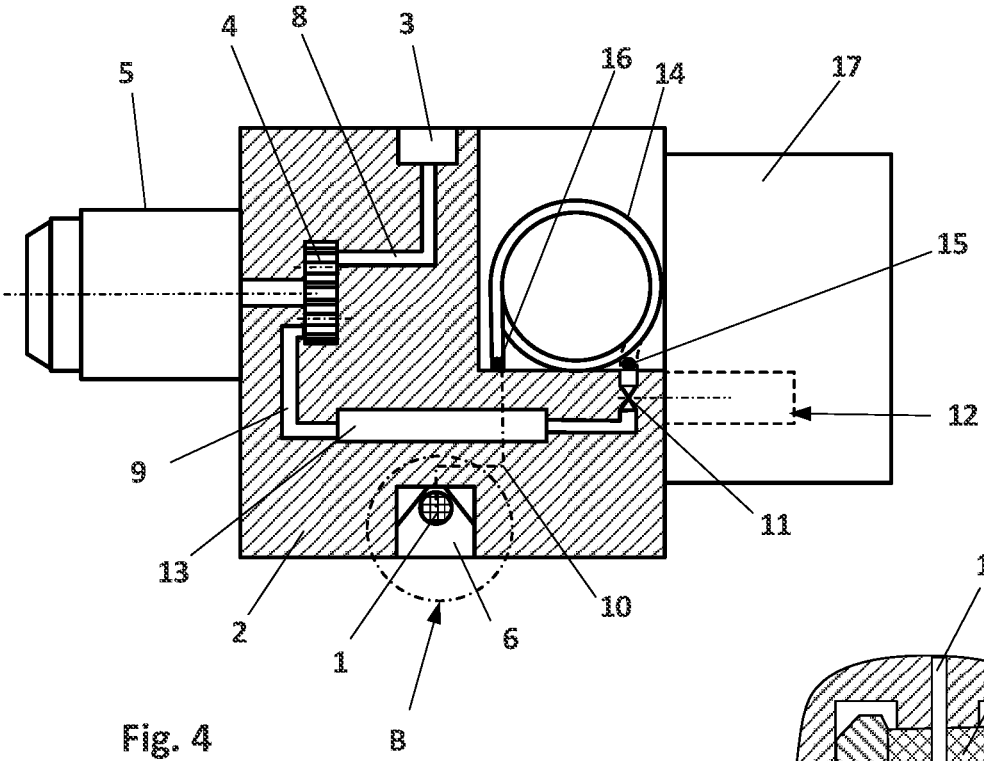
FIG. 4 shows a schematic sectional view at the location B-B according to FIG. 3

FIG. 3 shows a schematic view of a second embodiment of a device according to the invention and FIG. 4 shows a schematic sectional view at the location B-B according to FIG. 3. The basic structure of the second embodiment corresponds to the structure of the first embodiment; in the following, only the differences will be discussed and reference will be made to FIGS. 1 and 2 for the basic description. In the embodiment shown, the oil feed channel is not fully integrated in the housing 2. In the third portion 10 of the oil feed channel, a heating coil 14 is provided between the closure element 11 and the oil transfer element 7. The heating coil 14 has an input temperature measurement 15 at the end thereof facing the closure element 11 and an output temperature measurement 16 at an opposite end. Temperature measurements 15 and 16 can be used to determine a heating energy required to achieve a predetermined initial temperature of the oil at the end of heating coil 14. The viscosity of the oil is controlled by the temperature of the oil as it flows out of the oil transfer element 7, regardless of the temperature thereof as it enters the device through the oil port 3. Further, a controller 17 is attached to the housing. The controller includes all elements necessary for the operation of the device and has a visualization 18 and a keypad 19. Visualization 18 is shown as a display by way of example. With the aid of visualization 18 and keypad 19, the device for oiling a moving yarn 1 can be operated autonomously. Alternatively, a touchscreen can be used for visualization and input of data.

Figure 5:
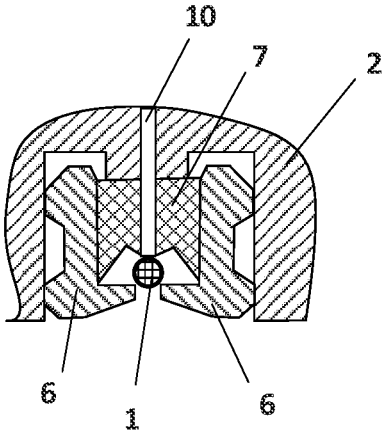
FIG. 5 shows an enlarged sectional view at location C according to FIG. 4.

FIG. 5 shows an enlarged sectional view at location C according to FIG. 4. Oil reaches the oil transfer element 7 via the third portion 10 of the oil feed channel guided in the housing 2. The oil transfer element 7 is held in a recess in the housing 2 by the yarn guiding device 6. The yarn guiding device 6 is designed as a two-part element at the location of the oil transfer element 7 by way of example. The two elements of the yarn guiding device 6 are clamped in the recess of the housing 2.

The present invention is not limited to the embodiments as shown and described. Modifications within the scope of the claims are possible, as well as a combination of the features, even if these are shown and described in different embodiments.

LIST OF REFERENCE SIGNS

1 Yarn
2 Housing
3 Oil port
4 Dosing pump
5 Drive motor
6 Yarn guiding device
7 Oil transfer element
8 First portion of the oil feed channel
9 Second portion of the oil feed channel
10 Third portion of the oil feed channel
11 Closure element
12 Electromagnetic drive
13 Flow sensor
14 Heating coil
15 Input temperature measurement

16 Output temperature measurement
17 Controller
18 Visualization
19 Keypad

The invention claimed is:

1. A device for oiling a moving yarn, comprising:
a controller;
a housing, and an oil port provided in the housing;
a dosing pump arranged in the housing such that the housing defines an integral operational cover component of the dosing pump;
a yarn guiding device configured on the housing with an oil transfer element embedded therein such that the moving yarn moves through the oil transfer element within the yarn guiding device;
the oil transfer element connected to the oil port by an oil feed channel via the dosing pump;
a closure element and a flow sensor provided in the oil feed channel;
the oil feed channel defined by the housing and comprising a first portion from the oil port to the dosing pump, a second portion from the dosing pump to the closure element, and a third portion from the closure element to the oil transfer element;
wherein the flow sensor is provided in the second portion of the oil feed channel; and
the dosing pump is controlled by the controller to deliver a metered flow of oil to the oil transfer element based on yarn type and yarn speed without excess oil leakage from the yarn guiding device.

2. The device according to claim 1, wherein the dosing pump comprises a gear pump with a controlled drive motor.

3. The device according to claim 1, wherein the closure element comprises a shut-off valve with an electromagnetic drive.

4. The device according to claim 1, wherein the third portion of the oil feed channel is formed at least partially as a heating coil.

5. The device according to claim 4, wherein the heating coil comprises an input temperature measurement device and an output temperature measurement device.

6. The device according to claim 1, wherein the yarn guiding device is mounted on an outer side of the housing and is open towards a surrounding of the housing.

7. The device according to claim 1, wherein the yarn guiding device is held in the housing in a linearly displaceable manner.

8. The device according to claim 1, wherein the oil transfer element is detachably connected to the yarn guiding device.

9. The device according to claim 1, wherein a display and a keypad are provided in the housing.

10. The device according to claim 9, wherein one or more of the following are displayed by the display: an oil quantity; an oil temperature; an oil consumption; an operating state; an operating mode; an operating time; or an operating instruction.

11. A method for oiling a moving yarn with the device according to claim 1, the method comprising: the controller closing the oil feed channel by actuating the closure element when the dosing pump is at a standstill.

12. The method according to claim 11, wherein the controller regulates an oil quantity reaching the yarn guiding device via the drive motor of the dosing pump.

13. The method according to claim 11, wherein the third portion of the oil feed channel is formed at least partially as a heating coil, wherein a temperature of the oil at an output of the heating coil is controlled by the controller.

14. The method according to claim 11, wherein the controller operates the device autonomously, wherein communication with the controller is conducted via a display screen and a keypad configured with the housing.

15. The method according to claim 14, wherein the controller is in communication with a superior controller that determines an oil dosing quantity or oil temperature to be maintained by the controller.

* * * * *